US006364361B1

(12) United States Patent
Kushner

(10) Patent No.: US 6,364,361 B1
(45) Date of Patent: Apr. 2, 2002

(54) BOOK HOLDER

(76) Inventor: Stephen P. Kushner, 371 NW. 76th Ave., No. 103, Margate, FL (US) 33063

( * ) Notice: Subject to any disclaimer, the term of this patent is extended or adjusted under 35 U.S.C. 154(b) by 0 days.

(21) Appl. No.: 09/842,811

(22) Filed: Apr. 27, 2001

(51) Int. Cl.[7] ..... B42D 17/00

(52) U.S. Cl. ..... 281/45; 248/441.1; 281/15.1; 281/21.1

(58) Field of Search ..... 281/15.1, 21.1, 281/22, 29, 34, 37, 43, 44, 45, 51; 402/70, 73; 248/441.1, 444, 447.2, 460; 446/73

(56) References Cited

U.S. PATENT DOCUMENTS

| | | | | |
|---|---|---|---|---|
| 1,196,715 | A | | 8/1916 | Noll |
| 1,431,106 | A | | 10/1922 | Edwards |
| 1,784,237 | A | | 12/1930 | Kaiser |
| 2,035,670 | A | | 3/1936 | Rubenstein |
| 2,674,061 | A | | 4/1954 | Minick |
| 3,604,727 | A | | 9/1971 | Wilkin |
| 4,382,617 | A | | 5/1983 | Fortier |
| 4,702,453 | A | * | 10/1987 | Bishop ..... 248/447.2 |
| 5,059,149 | A | * | 10/1991 | Stone ..... 446/73 |
| D325,059 | S | * | 3/1992 | Smallwood ..... D21/159 |
| 5,829,787 | A | * | 11/1998 | Newhouse, Jr. ..... 281/46 |
| 5,979,940 | A | * | 11/1999 | Araghi ..... 281/45 |

FOREIGN PATENT DOCUMENTS

| | | |
|---|---|---|
| CH | 136939 | 2/1930 |

* cited by examiner

*Primary Examiner*—Willmon Fridie, Jr.
(74) *Attorney, Agent, or Firm*—Stephen R. Greiner

(57) ABSTRACT

A holder for supporting a book upright and open. The holder includes a base portion upon which is positioned a movable portion. The base portion includes a foot for positioning upon a supporting surface and supporting the bottom of a book. A leg extends upwardly from the foot. The movable portion has both a spine that slidably engages the leg and a pair of outstretched arms extending from the spine. An uncomplicated locking mechanism is provided for fixing the position of the movable portion on the base portion. A pair of hook-like hands is affixed at the ends of the arms for grasping the top of an opened book.

5 Claims, 1 Drawing Sheet

BOOK HOLDER

FIELD OF THE INVENTION

The present invention relates generally to supports for books, copy and musical scores.

BACKGROUND OF THE INVENTION

Many devices have been used to hold books open for easier reading. Clips, clamps, stands, and racks of various sorts have all been employed at one time or other. Inabilities to support a book in an upright orientation and cumbersome adjustment features to accommodate books of varied size have prevented most of these devices from attaining widespread commercial acceptance. Thus, a need presently exists for a book holder that can be easily adjusted to retain virtually any book open and upright for reading.

SUMMARY OF THE INVENTION

In light of the problems associated with the known devices for retaining books open, it is a principal object of the invention to provide a holder that can be easily adjusted to retain a book in an open, upright orientation for "hands free" reading. The holder can be manually adjusted to accommodate books of various heights, widths and thicknesses. The holder will be of particular help to chefs working in a kitchen where grasping a cookbook with food-laden hands can damage the cookbook's pages. Workers in other trades would find the holder to be of similar usefulness.

It is another object of the invention to provide a book holder of the type described that is padded to prevent damage to a book. The padding can be configured like a doll or stuffed animal. Thus, the holder can serve as a toy for children and encourage their reading of books.

It is an object of the invention to provide improved elements and arrangements thereof in a book holder for the purposes described which is lightweight in construction, inexpensive to manufacture, and fully dependable in use.

Briefly, my book holder achieves the intended objects by featuring a base portion having a foot and an upwardly extending leg. The leg has a slot and a lever extending into the slot. The lever has a free end that projects forwardly from the slot. A pair of locking pins extends laterally from the free end and a tab extends rearwardly from the free end through the slot. A movable portion is positioned on the base portion and has a spine slidably engaging the leg. The spine has a pair of retaining flanges joined by a plate to form a channel within which the leg slides. The plate has a slot within which the free end of the lever is slidably positioned. The slot in the plate has opposed sides with notches for selectively receiving the pins to prevent relative motion of the base and movable portions. A pair of arms, each having a hook-like hand, extends from the spine. The base and movable portions are padded and covered.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
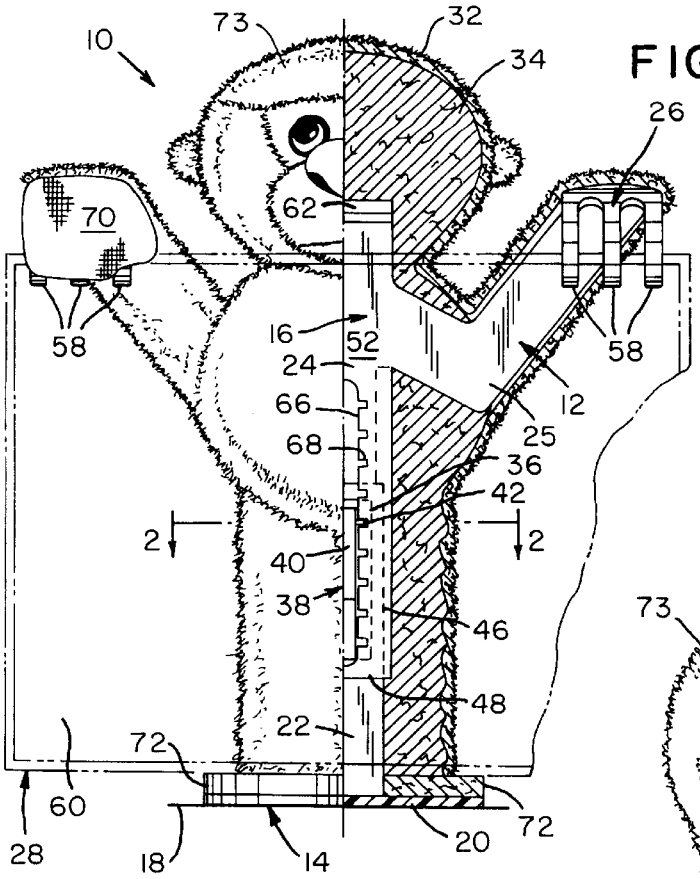
FIG. 1 is a front view of a book holder in accordance with the present invention with portions broken away to reveal details thereof.

Referring now to the FIGS., a book holder in accordance with the present invention is shown at 10. Book holder 10 includes a skeleton 12 having a base portion 14 that retains a movable portion 16 above a supporting surface 18. Base portion 14 has foot 20 for positioning upon surface 18 and a leg 22 extending upwardly from the rear of foot 20. Movable portion 16, on the other hand, has spine 24 slidably engaging leg 22 and a pair of outstretched arms 25 extending from spine 24. Hook-like hands 26 at the ends of arms 25 grasp a book 28. A flexible cover 32 filled with a fibrous batting 34 to resemble a doll encloses skeleton 12.

Base portion 14 is integrally formed from a stiff, yet somewhat resilient, plastic material. Foot 20 is a flat plate with dimensions sufficient to retain skeleton 12 upright during use. Leg 22 is a vertically oriented bar having a slot 36 provided therein. Extending upwardly from the bottom of slot 36 is a movable lever 38 that is integrally formed with the remainder of leg 22. Lever 38 has an upper, free end 40 that normally projects forwardly from slot 36. A pair of locking pins 42 extends laterally from free end 40. A tab 44 extends rearwardly from free end 40 through slot 36 and permits lever 38 and locking pins 42 to be pushed forwardly.

Movable portion 16 is formed from the same material as base portion 14, spine 24, arms 25 and hands 26 and is an integral unit. Spine 24 has a pair of L-shaped, retaining flanges 46 joined at their respective front ends by a plate 48 to form a C-shaped channel 50 within which leg 22 may slide. Preferably, plate 48 extends above the tops of retaining flanges 46 and arms 25 project outwardly and upwardly from the extension 52. A hand 26 extends forwardly from the top of each of the arms 25 and defines a hook having a horizontal shank 54 with a curved portion 56 extending downwardly from the front of shank 54. Each curved portion 56 is divided by vertical passages into a plurality of closely spaced fingers 58 capable of snugly gripping the curving pages 60 of book 28.

Extending forwardly from the top of extension 52 between arms 25 is a jaw 62 that serves to grasp the spine 64 of book 28. Jaw 62 extends to the approximate midpoint between extension 52 and the ends of fingers 58 to provide space for pages 60 of book 28 to be received. Jaw 62 slopes downwardly from extension 52 so that spine 64 of book 28 is pushed toward plate 48 when movable portion 16 is brought downwardly into engagement with the top of book 28.

Plate 48 is provided with a slot 66 into which the free end 40 of lever 38 is slidably positioned. Slot 66 is about twice as tall as free end 40 thereby permitting the height of skeleton 12 to be significantly varied to accommodate both large and small books. The opposed sides of slot 66 are provided with a series of vertically spaced notches 68 for snugly receiving pins 42 and selectively preventing relative motion between base and movable portions 14 and 16.

Flexible cover 32 is an inverted bag that encloses most of skeleton 12, closely following its contours whether in an extended or retracted state as described below. The space between skeleton 12 and cover 32 is filled in selected areas with a multitude of soft, polyester fibers or other suitable batting 34 to give book holder 10 bulk and resilience enough to press book 28 into snug engagement with fingers 58. As shown, the foot 20 of base portion 14 and the fingers 58 of movable portion 16 are not enclosed by cover 32 but are provided with felt pads 70 and 72 that serve to protect book 28 but are somewhat more durable than fur.

Cover 32 is configured to have an appearance like that of a monkey or like animal. Thus, cover 32 is provided with a head 73 located generally above jaw 62 that is decorated with eyes, ears, a nose and a mouth. A tail 74 is secured to the rear of cover to further mimic the appearance of a monkey.

Figure 2:
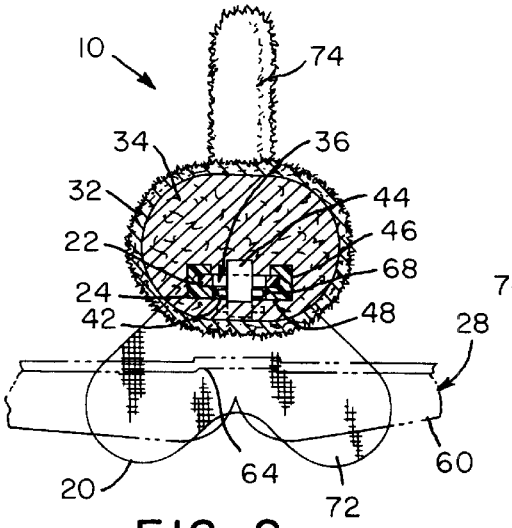
FIG. 2 is a cross-sectional view taken along line 2—2 of FIG. 1.
Figure 3:
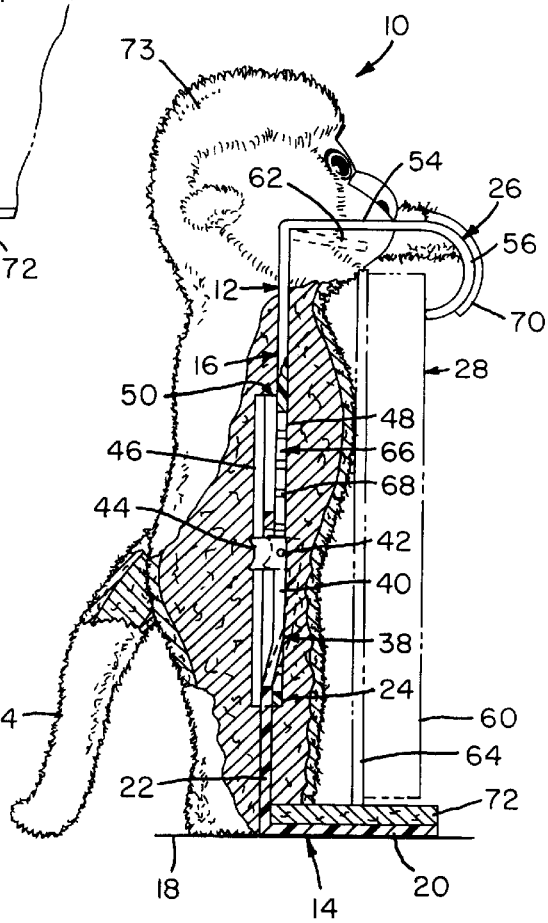
FIG. 3 is a side view of the book holder with portions broken away to reveal details thereof.

Use of book holder 10 is straightforward. First, book 28 is opened and positioned beneath hands 26 with the top of spine 64 pressing upwardly toward jaw 62 and pages 60 pressing against the tips of fingers 58. Next, a thumb is pressed against cover 32 at the top of tail 74 compressing batting 34, engaging tab 44 and deflecting lever 38 forwardly to the broken line position of FIGS. 2 and 3 wherein pins 42 are released from their normal resting positions in notches 68. While continuing to hold lever 38 in the deflected position, spine 24 is moved along leg 22 to a position wherein pad 72 presses firmly against the bottom of spine 64. Then, tab 44 is released, permitting lever 38 to return to the undeflected, solid-line position of the FIGS. with pins 42 entering another pair of notches 68, again fixing the height of skeleton 12. With book 28 now held open by holder 10, foot 20 is positioned on supporting surface 18 and book 28 is read in a substantially hands-free manner.

The pages 60 of book 28 can be manually turned. To do this, a user need only press rearwardly and downwardly on a page to release such from the fingers 58 of a hand 26. (If book 28 has substantial thickness, the hand 26 can also be pulled upwardly to assist in releasing the selected page.) Then, the released page is pressed rearwardly and upwardly behind the fingers 58 of the other hand 26. The process requires just seconds to complete and can be performed with minimal practice.

While the invention has been described with a high degree of particularity, it will be appreciated by those skilled in the art that modifications may be made thereto. For example, holder could be made and used without cover 32 and batting 34. Furthermore, the tips of fingers 58 may be coated with rubber to further prevent any possibility of marring of book 28. Therefore, it is to be understood that the present invention is not limited to the sole embodiment described above, but encompasses any and all embodiments within the scope of the following claims.

I claim:

1. A book holder, comprising:

a base portion having:

a foot for positioning upon a supporting surface; and, a leg extending upwardly from said foot, said leg having:

a first slot therein;

a movable lever secured to said leg and extending into said first slot, said lever having:

a free end that normally projects forwardly from said first slot;

a pair of locking pins extending laterally from said free end;

a tab extending rearwardly from said free end through said first slot permitting said lever and said locking pins to be pushed forwardly;

a movable portion having:

a spine slidably engaging said leg, said spine having:

a pair of retaining flanges; and, a plate joining said retaining flanges together so as to form a channel within which said leg may slide, said plate having a second slot within which said free end of said lever is slidably positioned, said second slot having opposed sides with a plurality of vertically spaced notches for snugly receiving said pins thereby selectively preventing relative motion between said base portion and said movable portion;

a pair of outstretched arms extending from said spine; and, a pair of hook-like hands at the ends of said arms.

2. The book holder according to claim 1 further comprising a flexible cover filled with a fibrous batting enclosing said base portion and said movable portion.

3. The book holder according to claim 1 wherein each of said hands includes a forwardly extending shank and a curved portion extending downwardly from the front of said shank, said curved portion being divided into a plurality of closely spaced fingers for independently gripping a book.

4. The book holder according to claim 1 further comprising a jaw extending forwardly and downwardly from the top of said spine for engaging the top of a book.

5. The book holder according to claim 1 further comprising a plurality of pads each being respectively affixed to said foot and said hands.

* * * * *